United States Patent [19]

Mueller et al.

[11] Patent Number: 4,796,459

[45] Date of Patent: Jan. 10, 1989

[54] ACCUMULATOR SYSTEM FOR CLOSED DIE FORGING

[75] Inventors: William A. Mueller, Fairhaven; Wolfgang Hoffmann, Grosse Pointe Woods, both of Mich.

[73] Assignee: General Motors Corporation, Detroit, Mich.

[21] Appl. No.: 93,888

[22] Filed: Sep. 8, 1987

[51] Int. Cl.[4] ..... B21D 22/00

[52] U.S. Cl. ..... 72/354; 72/358; 72/359; 72/453.01; 72/453.13; 267/119

[58] Field of Search ..... 72/350, 351, 352, 353, 72/354, 358, 359, 453.01, 453.13; 267/119, 130

[56] References Cited

U.S. PATENT DOCUMENTS

| | | | |
|---|---|---|---|
| 2,627,652 | 2/1953 | Schweller | 72/359 |
| 3,583,198 | 6/1971 | Drallmeier | 72/358 |
| 4,274,276 | 6/1981 | Mettler | 72/354 |
| 4,321,818 | 3/1982 | Bessho | 72/358 |
| 4,466,266 | 8/1984 | Gardner et al. | 72/358 |
| 4,599,887 | 7/1986 | Asai et al. | 72/453.13 |
| 4,604,886 | 8/1986 | McGregor, Jr. | 72/359 |
| 4,611,482 | 9/1986 | Hara | 72/354 |

*Primary Examiner*—David Jones
*Attorney, Agent, or Firm*—Saul Schwartz

[57] ABSTRACT

An accumulator system for establishing a clamping force on dies in a closed die forging device. The accumulator system includes an accumulator having a differential piston and a free piston. The small end of the differential piston forms a wall of the accumulator oil chamber hydraulically connected to variable volume oil chambers behind the dies. The big end of the differential piston and one side of the free piston form a low pressure gas chamber of the accumulator. The other side of the free piston forms a wall of a high pressure gas chamber of the accumulator. As the dies of the forging apparatus close, oil in the chambers behind the dies moves the differential piston against only the gas pressure in the low pressure gas chamber so that closure is essentially without impact. Just before the onset of forging, the big end of the differential piston engages the free piston so that thereafter the two move as a unit against the higher gas pressure in the high pressure gas chamber of the accumulator whereby the clamping force on the dies increases at a higher rate.

2 Claims, 3 Drawing Sheets

| FIG 2A | FIG 2B |
|---|---|

ACCUMULATOR SYSTEM FOR CLOSED DIE FORGING

BACKGROUND OF THE INVENTION

1. Field of the Invention

This invention relates generally to apparatus for closed die metal forging and, more particularly, to an accumulator system for controlling the clamping pressure on the dies during the forging operation.

2. Description of the Prior Art

In closed die forging, dies on bolster and ram elements of a forging machine are clamped together by fluid pressure as a punch and an anvil on the ram and the bolster first upset and then extrude a metal blank or slug within a closed die cavity defined between the dies. To minimize noise and impact, it is desirable that the fluid pressure be low when the dies make initial closing contact. However, because of the high separating forces on the dies characteristic of upsetting and extrusion, the fluid pressure must very quickly achieve a correspondingly high magnitude. Typically, clamping force on the dies is developed in variable volume oil chamber behind the dies and a conventional single piston air/oil accumulator is connected to the oil chambers such that clamping pressure increases as a function of ram travel. In such systems, the limited available ram travel after the dies engage renders it is difficult to achieve both quiet die closing and acceptably high ultimate oil pressure. That is, if the initial oil pressure is low for quietness the ultimate pressure will be insufficient for upsetting/extrusion and if the ultimate pressure is sufficient for upsetting/extrusion the initial pressure will be too high for quietness. An accumulator system according to this invention represents an improvement over the aforesaid systems in that it incorporates simple and economical structure whereby quiet die engagement and high ultimate oil pressure for clamping the dies together are both readily achieved.

SUMMARY OF THE INVENTION

This invention is a new and improved accumulator system for controlling the clamping force on dies in a closed die forging operation. The accumulator system according to this invention includes a housing and a differential area piston slidably mounted in the housing, the small end of the piston forming a moving wall of an accumulator oil chamber and the big end of the piston forming a moving wall of a low pressure gas chamber of the accumulator. The accumulator system according to this invention further includes a free piston slidably disposed in the accumulator housing for movement between extended and retracted positions. One side of the free piston forms a second wall of the low pressure gas chamber and the other side of the free piston forms a movable wall of a high pressure gas chamber of the accumulator, the remaining sides of the high pressure gas chamber being formed by the accumulator housing. The oil pressure clamping the dies together is the same as the oil pressure in the accumulator oil chamber and is initially low due to the low gas pressure in the accumulator low pressure gas chamber so that engagement of the dies is quiet and without impact. After the dies engage, the differential piston moves toward the free piston as the low pressure chamber collapses and the gas pressure therein increases at a rate sufficient to hold the dies together at the onset of metal deformation within the die cavity. Just before the onset of metal deformation, the differential piston engages the free piston and moves the latter as a unit therewith against the higher pressure in the high pressure gas chamber of the accumulator whereby the oil pressure and clamping force on the dies increase at a second, faster rate to maximum magnitudes sufficient to hold the dies closed throughout upsetting and extrusion of the slug within the die cavity. In a preferred embodiment of the accumulator system according to this invention, a control valve connected to the high pressure gas chamber of the accumulator limits gas pressure therein to a magnitude sufficient to hold the dies together during metal deformation but not so great as to unnecessarily stress the closed die forging apparatus.

DESCRIPTION OF A PREFERRED EMBODIMENT

Figures 1, 2A:
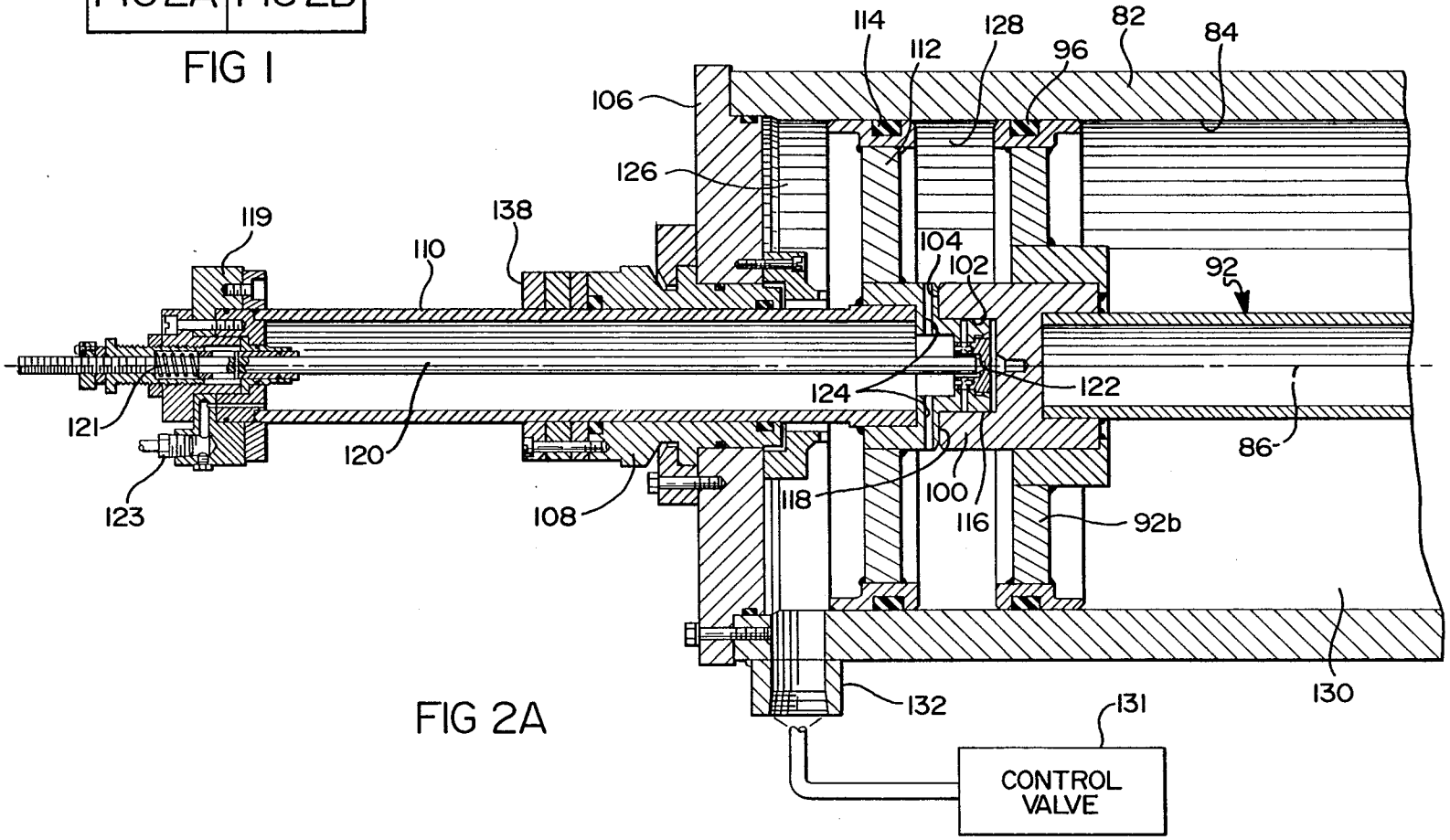
FIG. 1 is a block diagram showing the arrangement of FIGS. 2A and 2B.
Figure 2B:
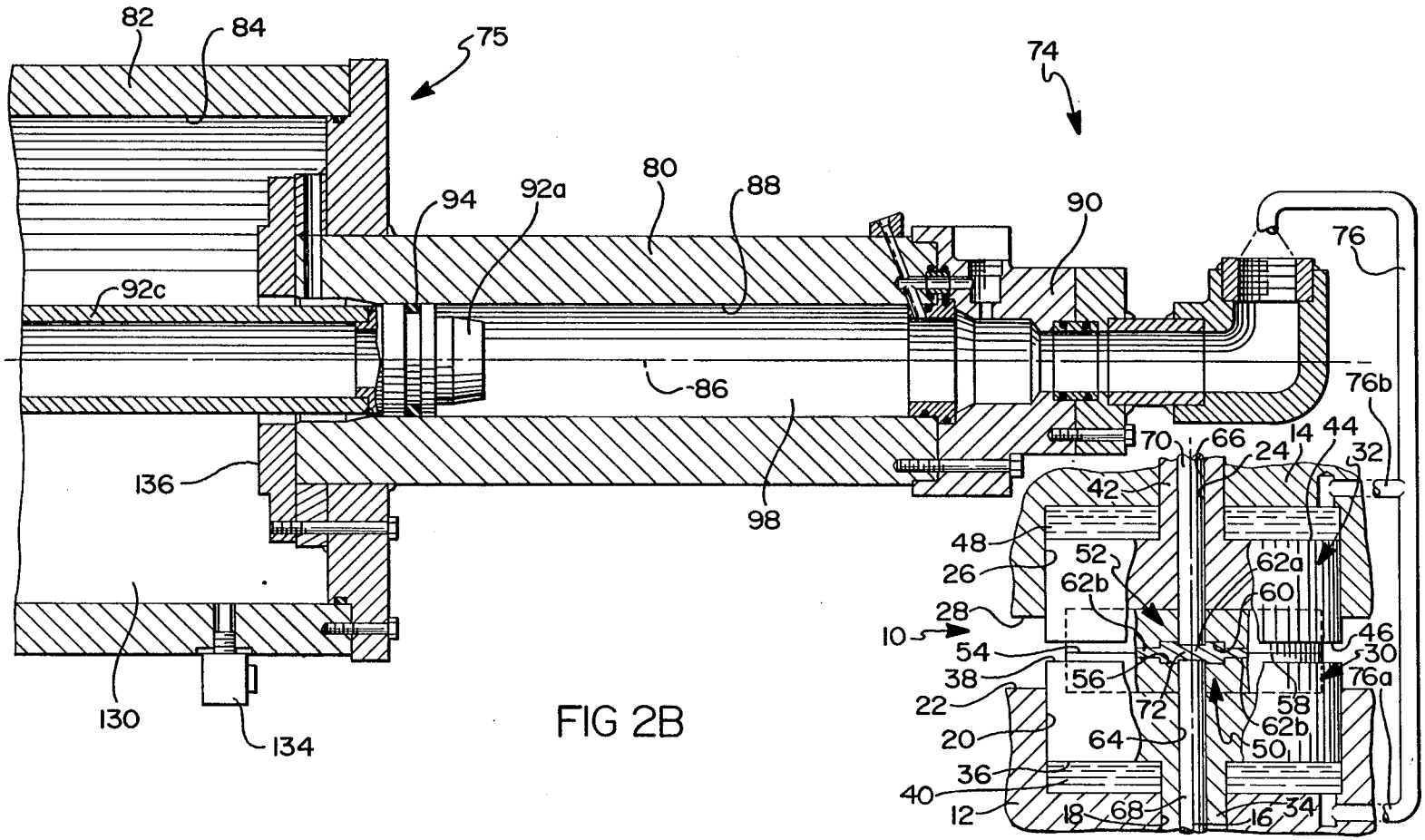
FIG. 2 is a fragmentary schematic view of a closed die forging apparatus and of an accumulator system according to this invention showing the accumulator system in longitudinal section.

Referring first to FIG. 2B of the drawings, a schematically illustrated closed die forging apparatus 10 includes a forging machine having a stationary bolster member 12 and a ram member 14. The ram member moves in vertical strokes relative to the bolster member in the direction of an axis 16 of the forging machine between a top dead center position (TDC), not shown, defining a maximum separation between the ram and bolster members and a bottom dead center position (BDC), FIGS. 2B, defining a minimum separation between the ram and bolster members. The bolster member 12 has a bore 18 therein which opens into a larger diameter cylindrical counter bore 20 in a top surface 22 of the bolster member. The bore 18 and the counter bore so are each aligned on the vertical axis 16. Similarly, the ram member 14 has a bore 24 therein which opens into a larger diameter cylindrical counter bore 26 in a bottom surface 28 of the ram member. The bore 24 and the counter bore 26 are each aligned on the vertical axis 16.

The closed die forging apparatus 10 further includes a first die support 30 slidably disposed in the bore 20 in the bolster member 12 for bodily movement relative to the latter in the direction of axis 16 and a second die support 32 slidably disposed in the bore 26 in the ram member 14 for bodily movement relative to the latter in the direction of axis 16. The first die support 30 has a small diameter neck 34, an annular inboard surface 36 around the neck 34 in a plane perpendicular to the axis 16, and an outboard surface 38 also in a plane perpendicular to the axis 16. The neck 34 is closley but slidably received in the bore 18 so that their inboard surface 36 of the first die support cooperates with the closed end of the counter bore 20 in defining an annular, variable volume, first oil chamber 40. The second die support 32 has a small diameter neck 42, an annular inboard surface 44 around the neck 42 in a plane perpendicular to the axis 16, and an outboard surface 46 also in a plane perpendicular to the axis 16. The neck 42 is closely but slidably received in the bore 24 so that the inboard surface 44 of the second die support cooperates with the closed end of the counter bore 26 in defining an annular, variable volume, second oil chamber 48.

The closed die forging apparatus further includes a first die 50 and a second die 52. The first die is rigidly attached to the first die support 30 in an appropriate recess in the outboard surface 38 of the latter. The first die 50 has a flat surface 54, referred to herein as the parting surface 54, in a plane perpendicular to the axis 16 and a first cavity 56 in the parting surface. Likewise, the second die 52 is rigidly attached to the second die support 32 in an appropriate recess in the outboard surface 46 of the latter. The second die 52 has a flat surface 58, referred to herein as the parting surface 58, in a plane perpendicular to the axis 16 and a second cavity 60 in the parting surface. When the parting surfaces 54 and 58 of the first and second dies 50 and 52 abut, the first and second cavities 56 and 60 cooperate in defining a closed die cavity having a center portion **62*a* and oppositely extending side portions 62*b*. The side portions 62*b*** are diametrically opposite each other and are representative of other side portions, not shown, which radiate from the center portion.

With continued reference to FIG. 2B, a cylindrical anvil bore 64 is aligned on the axis 16 and extends thorough the first die support 30 and the first die 50 and intersects the first cavity 56. A cylindrical punch bore 66 is aligned on the axis 16 and extends thorough the second die support 32 and the second die 52 and intersects the second cavity 60. A cylindrical anvil 68 rigidly connected to the bolster member 12 is slidably disposed in the anvil bore 64. A cylindrical punch 70 rigidly connected to the ram member 14 is slidably disposed in the punch bore 66.

When the dies 50 and 52 abut on the parting surfaces 54 and 58 respectively, the punch 70 and the anvil 68 operate through their respective distal ends on a metal work piece or slug 72 in the die cavity. By exerting very high compressive forces on the slug, the punch and anvil plastically deform the slug from a pre-form not conforming to the shape of the die cavity to a completed workpiece which completely fills the center portion **62*a* and the side portions 62*b* of the die cavity. In containing the slug during deformation, very high separating forces are exerted on the dies 50 and 52. In order to assure minimum finish machining after forging, it is necessary that the dies 50 and 52 be clamped together with sufficient clamping force to prevent extrusion of metal out of the forging chamber between the parting surfaces 54 and 58. To that end, an accumulator system 74 according to this invention is connected to the closed die forging apparatus 10**.

Referring to FIGS. 2A and 2B, the accumulator system 74 includes an accumulator 75 and an oil pipe 76 having a branch **76*a* connected to the first oil chamber 40 and a branch 76*b* connected to the second oil chamber 48. The accumulator 75 has a small diameter cylindrical housing portion 80 and a large diameter cylindrical housing portion 82 rigidly connected to the small diameter portion at a first or left end of the latter. The large diameter housing portion 82 has an internal cylindrical wall 84 centered about an axis 86 of the accumulator. The small diameter housing portion has a cylindrical bore 88 therein aligned on the axis 86. The bore 88 is open at the left end of the small diameter housing portion and is closed at the other or right end by an end cap 90. The end cap has a high pressure fitting thereon through which the oil pipe 76 communicates with bore 88 in the small diameter housing portion. The bore 88 is thus hydraulically connected to each of the oil chambers 40 and 48 in the closed die forging apparatus 10**.

The accumulator 75 further includes a differential piston 92. The differential piston 92 includes a small piston **92*a* slidably disposed in the bore 88 in the small diameter housing portion 80, a big piston 92*b* slidably disposed in the internal cylindrical wall 84 of large diameter housing portion 82, and a tubular piston rod 92*c* rigidly connected to the big and small pistons. A seal ring 94 on the small piston slidably seals against the bore 88. A seal ring 96 on the big piston slidably seals against the internal cylindrical wall 84. The small piston 92*a* cooperates with the end cap 90 in defining a variable volume oil chamber 98 of the accumulator within the small diameter housing portion 80. The big piston 92*b* has a center fitting 100 thereon which defines an internal pilot bore 102 aligned on the axis 86 and surrounded by an annular abutment shoulder 104 in a plane perpendicular to the axis 86**.

As seen best in FIG. 2A, the large diameter housing portion 82 is closed at its left end by a rigid cover 106. The cover has a tubular guide bushing 108 thereon aligned on the axis 86 of the accumulator. The guide bushing 108 slidably receives a tubular guide 110. Appropriate seal rings on the guide bushing slidably seal against the outside wall of the guide 110. Within the large diameter housing portion 82, a free piston 112 is rigidly connected to the end of the tubular guide 110. The free piston 112 is slidably received in the internal cylindrical wall 84 and a seal 114 on the free piston slidably seals against the wall. The free piston 112 has a center portion on which is defined a cylindrical outside pilot 116 surrounded by an annular shoulder 118 in a plane perpendicular to the axis 86.

The tubular guide 110 is closed at its left end by a cap 119. A rod 120 in the guide is biased by a spring 121 against the inboard side of an orifice 122 in the free piston. A pressure fitting 123 on the cap 119 communicates with the inside of the guide 110 and is connected to a remote low pressure gas source, not shown. A pair of radial passages 124 through the free piston are in flow communication with the inside of the guide 110.

The big piston **92*b* of the differential piston 92 and the free piston 112 cooperate in defining two functional chambers and one non-functional chamber within the large diameter housing portion 82 of the accumulator. One of the two functional chambers is a variable volume high pressure gas chamber 126 defined between the cover 106 and the left side of the free piston 112. The other of the functional chambers is a variable volume low pressure gas chamber 128 defined between the right side of the free piston 112 and the left side of the big piston 92*b*. The non-functional chamber is an expansion chamber 130 defined between the right side of the big piston 92*b* and the right end of the large diameter housing portion 82. A remote high pressure gas source, not shown, communicates with the high pressure chamber 126 through a schematically illustrated control valve 131 and a fitting 132 on the large diameter housing portion 82. The control valve 131 is also operative to relieve or vent gas pressure in the high pressure gas chamber 126. The low pressure chamber 128 communicates with the aforesaid low pressure gas source through the fitting 123, the inside of the guide 110 and the radial passages 124. The expansion chamber 130 is vented to atmosphere through a fitting 134 on the large diameter housing portion 82**, FIG. 2B.

The differential piston 92 reciprocates within the large and small diameter housing portions 82 and 80, respectively, between an extended position, FIG. 2, and a retracted position, not shown. The retracted position of the differential piston is defined by engagement between a shoulder 136 on the large diameter housing portion 82 and the right side of the big piston **92*b*. The free piston 112 similarly reciprocates within the large diameter housing portion 82 between an extended position, FIG. 2A, and a retracted position, not shown. The retracted position of the free piston is defined by engagement between a shoulder 138 on the guide bushing 108 and the cap 119 on the guide 110. Gas pressure in each of the high and low pressure gas chambers 126 and 128 biases the differential piston 92 and the free piston 112** to their respective retracted positions.

In combination with the closed die forging apparatus 10, the accumulator system 74 operates as follows. When the ram member 14 is at TDC, the dies 50 and 52 are at maximum separation so that the slug 72 can be inserted between cavities 56 and 60. The slug generally conforms in shape to the center portion **62*a* of the die cavity. Concurrently, the high and low pressure gas chambers 126 and 128 are maintained at about 65 psi and 3 psi, respectively, so that the differential piston and the free piston assume their respective retracted positions. With the differential piston in its retracted position, the accumulator oil chamber 98 is at minimum volume while the oil chambers 40 and 48 behind the die supports 30 and 32** are at maximum volume.

When the forging machine is actuated, the ram member moves toward the bolster member. At a calculated increment above BDC, the dies 50 and 52 engage on the parting surfaces 54 and 58, respectively, with the slug 72 captured in the die cavity. In the next succeeding increments of ram member movement toward BDC, the oil chambers 40 and 48 start to collapse and the punch 70 and anvil 68 begin to penetrate into the die cavity. When the oil chambers 40 and 48 start to collapse, oil is forced into the accumulator oil chamber 98 whereby the differential piston 92 begins stroking to the left, FIGS. 2A and 2B, against the gas pressure in the low pressure gas chamber 128. Because the initial gas pressure in chamber 128 is relatively low, the engagement between the dies 50 and 52 is relatively soft and without needless shock and noise. The condition at die closure to represented point **140*a* on a curve 140**, FIG. 3, illustrating the relationship between die clamping force and ram displacement.

At the instant of die closure, the punch and the anvil do not engage the slug 72. In the next succeeding increments of ram member movement toward BDC, the punch approaches the slug 72 from above and the anvil 68 approaches the slug from below. At the same time, the oil chambers 40 and 48 continue to collapse as oil is forced therefrom into the accumulator oil chamber 98 thereby expanding the latter and moving the differential piston 92 from the retracted position toward the extended position. As the differential piston moves toward the extended position, the low pressure gas chamber collapses as the big piston **92*b* approaches the free piston 112. The gas pressure in the low pressure gas chamber, and hence the oil pressure in the chambers 40 and 48 and the clamping force on the dies, increases at a first rate as the low pressure gas chamber collapses. Just prior to the instant at which the punch 70 and the anvil 68 engage the slug 72, the pilot 116 on the free piston enters the pilot bore 102 on the differential piston and shoulder 104 on the big piston engages the shoulder 118 on the free piston. Gas trapped in the pilot bore 102 escapes through the orifice 122 when the pressure overcomes the spring 121 holding the rod 120 against the orifice. The condition at engagement between the shoulders 104 and 118 is represented by the point 140*b* on the curve 140, FIG. 3, and the increase in clamping force on the dies is represented by the portion of the curve 140 between the points 140*a* and 140*b***.

After the punch and anvil engage the slug 72, increments of movement of the ram member toward BDC are accompanied by rapidly increasing separating forces on the dies 50 and 52 as the slug is first upset to completely fill the center portion **62*a* of the die cavity and then extruded to fill the side portions 62*b* of the die cavity. The onset of slug deformation is represented by a point 142*a* on a curve 142**, FIG. 3, representing the relationship between die separation forces and ram member displacement.

Figure 3:
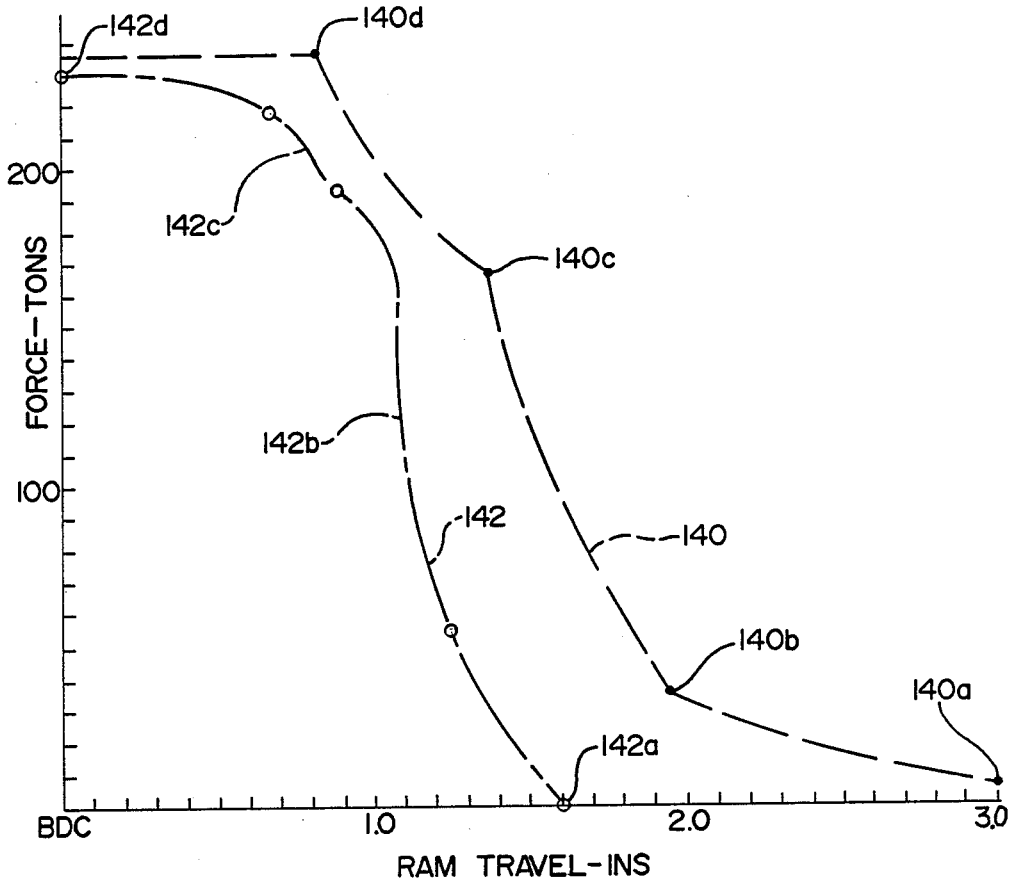
FIG. 3 is a graphic representation of the relationship between ram travel and die separating force and die clamping force for an accumulator system according to this invention.

As represented by the curve 142, FIG. 3, the separating force on the dies 50 and 52 increases rapidly after the onset of slug deformation. The curve 142 is representative of upset/extrusion of ferrous metal slugs generally and exhibits a characteristic steep portion **142*b* corresponding to upsetting and the initiation of extrusion and a less steep or portion 142*c*** corresponding to completion of extrusion. In order that the slug be confined to the die cavity all during upset/extrusion, the clamping force on the dies must always exceed the separating force.

To that end, the clamping force on the dies just prior to the onset of slug deformation, represented by point **142*a* on curve 142, exceeds the separating force developed at the onset of deformation. Thereafter, because further expansion of the accumulator oil chamber 98 is opposed only by the higher gas pressure in the high pressure gas chamber 126 of the accumulator, the clamping force on the dies increases at a more rapid rate for each succeeding increment of ram member movement toward BDC. This condition is represented by the portion of the curve 140, FIG. 3, to the left of point 140*b*. At each position of the ram member after the onset of slug deformation, the clamping force always exceeds the separating force on the dies so that the slug 72** is confined to the die cavity.

In order to minimize wear and tear on the forging apparatus 10, it is desirable to limit the clamping force to substantially just what is required to overcome the separating force. To that end, the control valve 131 is programmed to relieve the gas pressure in the high pressure gas chamber 126 as a function of displacement of the ram member 14. Accordingly, at a position of the ram member corresponding to the end of the steeply increasing portion **142*b* of the curve 142, the control valve opens to exhaust gas from the high pressure gas chamber 126 and reduce the rate at which the gas pressure therein increases for succeeding increments of ram member movement toward BDC. The condition when the control valve commences operation is represented by a point 140*c* on curve 140, FIG. 3, and the rate at which the clamping force on the dies thereafter increases is represented by the portion of the curve 140 to the left of point 140*c***.

As illustrated by a point **142*d* on curve 142, FIG. 3, the separating force on the dies is maximum when the ram member 14 achieves BDC. As is characteristic of closed die forging, the slope of the curve 142 decreases and becomes almost horizontal as the ram member approaches BDC. The control valve 131 then further relieves the gas pressure in the high pressure gas chamber to limit the maximum clamping force on the dies to slightly more than the maximum separating force. The position of the ram member at the onset of valve operation defining maximum clamping force on the dies is represented by a point 140***d* on curve 140, FIG. 3.

At BDC, slug upset/extrusion is complete. Thereafter, the ram member begins moving away from the bolster member toward TDC. At that instant, the pressure in the high pressure gas chamber is quickly relieved to a level sufficient to just return the free piston 112 to its retracted position without unnecessarily impacting the cap 119 against the shoulder 138. When the ram member achieves TDC, the valve 131 connects the high pressure gas chamber 126 to the remote source of high gas pressure thereby to reestablish the gas pressure in the chamber 126 at its initial high level in preparation for another forming cycle. Similarly, the valve connected to the aforesaid remote low pressure gas source reestablishes or maintains the gas pressure in the low pressure gas chamber at its initial low level in preparation for another forming cycle.

The embodiments of the invention in which an exclusive property or privilege is claimed are defined as follows:

1. In combination with a closed die forging apparatus wherein a closed die cavity is defined between a pair of dies clamped together by a fluid pressure in a variable volume oil chamber defined between at least one of said dies and an element of said forging apparatus movable through a forming stroke relative to said one die, said oil chamber having a maximum volume at the beginning of said forming stroke and a minimum volume at the conclusion of said forming stroke, an accumulator system comprising, an accumulator housing, a differential piston means having a big piston and a small piston disposed on said accumulator housing for movement between a retracted position and an extended position, said small piston cooperating with said accumulator housing in defining a variable volume accumulator oil chamber having a minimum volume in said retracted position of said differential piston and a maximum volume in said extended position of said differential piston, a free piston means disposed on said accumulator housing for movement between a retracted position and an extended position and cooperating with said accumulator housing in defining a variable volume high pressure gas chamber, said free piston cooperating with said big piston and with said accumulator housing in defining a variable volume low pressure gas chamber between said free piston and said big piston, a gaseous pressure medium in said high pressure gas chamber at an initial high pressure urging said free piston means to said retracted position, a gaseous pressure median in said low pressure gas chamber at an initial low pressure substantially lower than said initial high pressure urging said differential piston to said retracted position, and fluid conduit means between said variable volume oil chamber in said closed die forging apparatus and said accumulator oil chamber, oil in said variable volume oil chamber in said closed die forging apparatus being forced into said accumulator oil chamber during said forming stroke thereby to move said differential piston from said retracted position to said extended position first against resisting gas pressure in said low pressure gas chamber increasing from said initial low pressure to a maximum at engagement of said big piston on said free piston and second against resisting gas pressure in said high pressure gas chamber as said free piston moves as a unit with said differential piston, said resisting gas pressure achieving a maximum value at said extended positions of each of said differential piston and said free piston.

2. The accumulator system recited in claim 1 and further including valve means connected to said high pressure gas chamber operative to exhaust a portion of the gas in said high pressure gas chamber as a function of the position of said movable element of said forging apparatus thereby to reduce the rate of increase of said resisting gas pressure.

* * * * *